United States Patent [19]

Wisniewski et al.

[11] Patent Number: 4,960,533

[45] Date of Patent: Oct. 2, 1990

[54] SILICONE-BASED HARD SURFACE CLEANER

[75] Inventors: Karen L. Wisniewski, Bound Brook; Mary L. Knudson, Somerville, both of N.J.

[73] Assignee: Colgate-Palmolive Company, New York, N.Y.

[21] Appl. No.: 217,712

[22] Filed: Jul. 11, 1988

[51] Int. Cl.[5] ..... C11D 1/82

[52] U.S. Cl. ..... 252/142; 252/173; 252/174.15; 252/174.21

[58] Field of Search ..... 252/142, 173, 174.15, 252/174.21

[56] References Cited

U.S. PATENT DOCUMENTS

| | | | |
|---|---|---|---|
| 4,501,680 | 2/1985 | Aszman | 252/142 |
| 4,599,116 | 7/1986 | King | 134/2 |
| 4,689,168 | 8/1987 | Requejo | 252/139 |
| 4,822,854 | 4/1989 | Ciolino | 252/174.19 |

*Primary Examiner*—John F. Niebling
*Assistant Examiner*—Isabelle Rodriguez
*Attorney, Agent, or Firm*—Robert Sullivan; Murray Grill; Richard Ancel

[57] ABSTRACT

A solvent based upon a volatile silicone (cyclomethicone) which has a prime utility of removing soap scum or alkaline earth oxide stearates. The composition is utilized as a bi-composition of dimethycyloxane or cyclomethicone and Silwet L-77 (Union Carbide), a polyalkylene oxide modified dimethyl polysiloxane. The addition of glutaric acid to the composition adds a dicarboxylic acid which assists in emulsifying and loosening soil and an optimum pH aqueous solution. A preferred formula is given below and additional operative acids are citric and hydrochloric:

By weight
1% Cyclomethicone
2% Silwet L-77 (Union Carbide)
3% Glutaric Acid
94% Water

2 Claims, No Drawings

SILICONE-BASED HARD SURFACE CLEANER

The present invention comprises a hard surface ceramic composition which is volatile in nature and contains a siloxane and more specially a dimethyl siloxane present in two of the three components. Sample formulas utilizing the present invention are as follows: By weight 1% Cyclomethicone
2% Silwet L-77 (Union Carbide)
1–6 % acid selected from glutaric, citric and hydrochloric
Balance Water As for the cyclomethicone component, which is a cyclic dimethyl polysiloxane, the formula utilized is

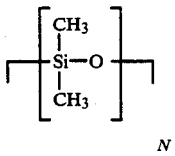

where N averages between 3 and 6

The Silwet L-77 (Union Carbide) compounds are fulfilled by the general formula:

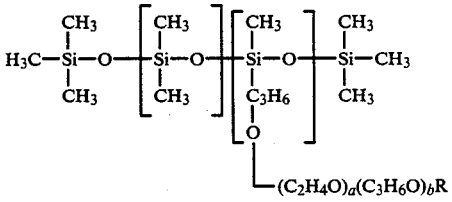

in which R can be either hydrogen or a lower alkyl radical Glutaric acid contains dioic acids $C_5H_8O_4$ or $COOH(CH_2)_3COOH$.

The volatile silicone, cyclomethicone, in this invention is used as a soap scum removal and, of course, a hard surface cleaning composition. The utilization of the composition is directed to cleaning or removing soap scum and in this use it is believed that cyclomethicone has never been used directly. The penetrating action of cyclomethicone on soap scum is combined with its volatility which may aid in spreading on the surface and in decreasing streaking of the formula.

The cyclomethicone is very effective at very low concentrations. The removal of the soap scum is aided by a surfactant that helps to stabilize the cyclomethicone in aqueous solution (Silwet L-77) and it is further helped by the addition of an acid, glutaric acid. It is noted that this formula may also have advantages as a kitchen all purpose cleaner or as a window cleaner.

The formula previously given may be expanded, retaining the efficacy of the formula as follows: By weight 1–2% Cyclomethicone
2–1% Silwet L-77 (polyalkylene oxide modified dimethyl polysiloxane)
6–1% Glutaric acid (pentanedioic acid $C_5H_8O_4COOH$ $(CH_2)_3COOH$
Balance Water Also, in general, the Silwet L-77 may be replaced by other modified dimethylsiloxanes of similar structure.

It will be seen that the base formulations are rather simple and glutaric acid may be expanded to other acids; to wit:

1.0% Cyclomethicone
1.0% Surfactant
1.0 to 6% to Acid
Balance Water

The pH of the formula is 4.0, adjusted with NaOH, to compare cleaning efficacy to other cleaners. The best cleaning efficacy is seen at pH 2.5, with 3.0% acid, which is the natural pH of the system. The cyclomethicone system was superior at equal acid levels in that glutaric or hydrochloric and or citric acids were used. Various surfactants—silicone, and hydrocarbon,—have been tried and are effective in the formulation. The mechanism for soil removal is penetration (to aid "roll up") and emulsification. The low surface tension of the volatile silicones (18–21 dynes/cm) allows for surface and soil wettability and the penetration of sticky substrate.

The order of addition of the components of the formulation is important to produce the obvious surface activity of the system. The order is: water, surfactant, acid and cyclomethicone. The surface activity is explained as a Marangoni effect. The Marangoni effect accompanies a superior spreading action that allows the formulation to climb up vertical tile surfaces and remove soap scum without mechanical action. This kind of surface activity is seen with various surfactants. Upon slight agitation the effect is prolonged. The Marangoni effect on the surface is not necessary for cleaning efficacy but is an added esthetic benefit. Also, Dow Corning X2-5155 and other silicone surfactants close in silicone number may be substituted for the polyalkylene oxide modified dimethyl polysiloxane.

Material Information Disclosure

The following patents are mentioned as pertinent prior art:

U.S. Pat. No. 4,337,166 Hill—describes a cyclic methylsiloxane.

U.S. Pat. No. 4,501,680 Aszman—a liquid detergent for cleaning soap scum from ceramic tile, etc.

U.S. Pat. No. 4,685,930 Kasprzak—a cyclosiloxane for removing spots; i.e., in cleaning textiles.

U.S. Pat. No. 4,689,168 Requejo—a hard surface cleaning composition embracing a volatile siloxane.

The patents noted above do not militate against the newness or originality of the present invention which is based upon the properties of cyclomethicone combined with another dimethylsiloxane which imparts added aqueous solubility to the mix.

EXAMPLE

Comparison testing between the cyclomethicone product of the present invention and one not containing cyclomethicone:

Soap scum was prepared and placed on two tiles (very similar soil loads). Two 1500 ml. beakers were filled to the 500 ml mark, one with the acidic liquid bathroom cleaner ("Superb," developed by Aszman and Everhart) and the other with the formulation above. The tiles were immersed in the respective beakers for 2 minutes. They were then removed, rinsed by dunking in a large beaker of water, and the surface wiped with a paper towel using light pressure until loose soil was removed. Spectrophotometer measurements were made to determine soil removal. The same tiles went through the procedure of soaking, rinsing, and wiping again except that the soaking time was changed to 1 minute. The amount of further soil removal was determined by spectrophotometer. The cycle was repeated one last time with a 1 minute soak and subsequent soil removal evaluation. Results are tabulated below:

| Cleaner | Soil Removal (%) | | |
|---|---|---|---|
| | 2 minutes | 3 minutes | 4 minutes |
| Superb | 31.3 | 38.6 | 88.9 |
| Sample formula | 34.5 | 74.3 | 94.8 |

The sample formula containing cyclomethicone was superior at all time intervals.

It is also contemplated that the formulation may include Neodol 91-8 nonionic surfactant as a partial or complete substitute for the Silwet L-77 Neodol 91-8 is a $C_9$–$C_{11}$ linear primary alcohol ethoxylate.

Almost any type of nonionic surfactant (both carbon and silicone based) could be used in the formulation as long as it had an HLB (hydrophile-lipophile balance) in the correct range. The HLB of Silwet L-77 is 7 and the HLB of Neodol 91-8 is 14. Although the cleaning performance does not change significantly over the range, the esthetics of the formulas are very different and can be altered by the choice of surfactant. Above HLB 14 the silicone oil is not effectively emulsified. At HLB 10 the oil is most completely emulsified but at the expense of spreading characteristics and Marangoni effect. Below HLB 7 the surfactant/oil combination becomes insufficiently miscible with water. The Neodol 91-8 appears to be the optimum choice for long-lived surface active characteristics, but the Silwet L77 gives more violent action (with lesser stability).

In summary, the formula of the present invention exhibit penetration of the soil and it is the formula's penetrating ability in conjuction with its spreading characteristics that provides its superior cleaning. The cyclomethicone, the surfactant, and the acid all play a role in the mechanism of penetration.

We claim:

1. A completely emulsified liquid detergent exhibiting Marangoni effect spreading characteristics for cleaning hard surfaces consisting of 1 to 2 percent cyclomethicone, 1 to 2 percent polyethylene oxide modified dimethyl polysiloxane, 1 to 6 percent glutaric acid and water.

2. The method of removing soap scum from hard surfaces consisting of applying to said surfaces a completely emulsified liquid detergent consisting of 1 to 2 percent cyclomethicone, 1 to 2 percent polyethylene oxide modified dimethyl polysiloxane, 1 to 6 percent glutaric acid and water and thereafter removing the solution along with the soap scum.

* * * * *